US005079571A

United States Patent [19]

Eriksen

[11] Patent Number: 5,079,571

[45] Date of Patent: Jan. 7, 1992

[54] INTERLACED PRINTING USING SPACED PRINT ARRAYS

[75] Inventor: Joern B. Eriksen, Oregon City, Oreg.

[73] Assignee: Tektronix, Inc., Beaverton, Oreg.

[21] Appl. No.: 567,027

[22] Filed: Aug. 14, 1990

Related U.S. Application Data

[63] Continuation-in-part of Ser. No. 528,518, May 25, 1990.

[51] Int. Cl.[5] ..... B41J 2/21

[52] U.S. Cl. ..... 346/140 R; 400/121; 400/126; 358/75

[58] Field of Search ..... 346/140, 75, 1.1; 400/121, 126; 358/75

[56] References Cited

U.S. PATENT DOCUMENTS

| | | | |
|---|---|---|---|
| 3,864,696 | 2/1975 | Fischbeck | 346/140 |
| 3,925,790 | 12/1975 | Fischbeck | 346/140 |
| 4,112,469 | 9/1978 | Paranjpe et al. . | |
| 4,131,898 | 12/1978 | Gamblin . | |
| 4,232,324 | 11/1980 | Tsao | 346/75 |
| 4,528,576 | 7/1985 | Koumura | 346/140 |
| 4,554,556 | 11/1985 | Hirata et al. . | |
| 4,580,150 | 4/1986 | Tazaki . | |
| 4,593,295 | 6/1986 | Matsufuji et al. | 346/140 |
| 4,630,076 | 12/1986 | Yoshimura . | |
| 4,680,596 | 7/1987 | Logan | 346/140 |
| 4,714,936 | 12/1987 | Helinski et al. | 346/140 |
| 4,728,968 | 3/1988 | Hillmann et al. | 346/140 |
| 4,741,930 | 5/1988 | Howard et al. . | |
| 4,812,859 | 3/1989 | Chan et al. | 346/140 |
| 4,864,328 | 9/1989 | Fischbeck | 346/140 |
| 4,965,593 | 10/1990 | Hickman | 346/140 |
| 4,967,203 | 10/1990 | Doan | 346/140 X |
| 4,978,971 | 12/1990 | Goetz | 346/140 X |

*Primary Examiner*—Joseph W. Hartary

*Attorney, Agent, or Firm*—John D. Winkelman; Edward B. Anderson

[57] ABSTRACT

Printing is by an array of color-printing elements or nozzles in order to produce interlaced color printing while printing each line only once with each color. Print head array configurations for printing two, three and four colors include linear and parallel arrays. In one embodiment, a first color and a second color are printed on alternate lines of a first set of print lines. The first color and a third color are printed on alternate lines of a second set of print lines. Also, the second color and the third color are printed on alternate lines of a third set of print lines. By sequentially printing these consecutive sets of lines on a print medium, with each of the three pairs of colors, all of the lines of an image are printed once with each color. Other color-printing configurations are also shown.

7 Claims, 5 Drawing Sheets

INTERLACED PRINTING USING SPACED PRINT ARRAYS

FIELD OF THE INVENTION

This is a continuation-in-part of application Ser. No. 07/528,518, filed May 25, 1990.

This invention relates to color printing wherein a color image is formed by printing repeated sets of lines with one or more colors by a print head scanning a print medium. It particularly relates to color printing with interlacing of black and/or the three conventional subtractive primary colors, cyan, magenta and yellow using spaced linear arrays of print nozzles.

BACKGROUND OF THE INVENTION

The preferred method and embodiment for practicing the present invention is particularly directed to an ink jet printer wherein a print head scans over a print medium, most typically a sheet of paper or transparent film, by shuttling back and forth across the sheet (bidirectional movement) or by moving continuously along the sheet in one direction while the sheet is held against a rotating drum. Images are formed by selectively and serially depositing ink drops of primary or base colors at uniformly spaced address locations disposed in uniformly spaced rows to form a dot-matrix image. Variations in color may be achieved by depositing one or more ink drops of more than one size or color at an address to form picture elements or pixels.

The present invention however is equally applicable to any printing process wherein a print head travels along parallel lines relative to a print medium to form a desired final image, whether the image be graphic or textual. In the following text, the term "print" is considered to include the general situation where a print element or nozzle addresses an ink drop location, whether or not ink is deposited. In the general situation the size of the drop may vary and even the number of drops of a given color that are deposited at a particular address can vary. Hewlett-Packard Labs has demonstrated the latter with drop-on-demand (DOD) thermal ink jets; and Hertz, at the Lund Institute in Sweden, has also demonstrated this with continuous ink jets. Printing with drops of several selected sizes (for gray scale control at each address) was demonstrated by MRIT with air assisted DOD jets in the early 1980s.

Print heads are known that contain a nozzle for each color of printing for a single line. These nozzles are positioned adjacent to a sheet of paper. A print head carriage then moves relative to the paper one line at a time depositing ink pixels at selected pixel locations until the entire image area has been scanned.

Representative of the prior art techniques is that disclosed in U.S. Pat. No. 4,630,076 issued to Yoshimura for "Ink-On-Demand Color Ink Jet System Printer". The devices disclosed therein show a plurality of sets of jet or nozzle arrays providing printing of all of the colors on each of a given set of print lines in a single scan of the print head (band printing). These devices print the color drops in one order when the print head is travelling in one direction, and in the reverse order when travelling in the other direction. This printer thus does not provide any form of interlacing: band, line, or color. The arrays of printing elements are spaced in the scan direction, do not form a continuous linear array with the primary colors, and are not spaced in the advance direction.

A variation of this technique is illustrated in U.S. Pat. No. 4,593,295 issued to Matsufuji et al. for "Ink Jet Image Recording Device with Pitch-Shifted Recording Elements". A double set of printing arrays are disclosed and offset in the direction of relative print medium movement so that the colors can be printed in the same order for both scan directions. As with the printer of Yoshimura, this printer prints all of the colors on a single line in a single pass of the print elements over a set of print lines. It does disclose separate sets of arrays, but these arrays print adjacent lines without advancing the print head relative to the print medium. The print arrays, one for each color, are spaced in the scan direction, but do not form a continuous linear array.

Other ink jets have more than one nozzle to print a given color on each address of a given line. One nozzle is used to print ink at its maximum optical density, and the other(s) to print ink at some diluted dye concentration(s) so that more than one optical density level of the color can be obtained at each address. Again, such techniques involve the near simultaneous depositing of ink drops on pixel or image elements that are effectively in adjacent lines or in the media advance direction, as well as on the same pixel or image element. The resulting bleeding produces visually perceptible lines in the direction of print head traverse or scan across a print medium.

Some early printers also had the nozzles aligned normal to the scan direction for scanning spaced-apart parallel lines. Thus, colors are always laid down in the same sequence, and one color has time to dry before the next one is printed on top of it. Such systems do not provide for color, line or band interlacing, since printing is done with a single nozzle for each color. These printers did not use multiple spaced arrays with printing elements for each color spaced apart from printing every-other line.

Hirata et al., in U.S. Pat. No. 4,554,556 entitled "Color Plotter", disclose printing a dot with all three colors at once, or sequentially during a single scan. Tozaki, in U.S. Pat. No. 4,580,150 entitled "Recording Apparatus", discloses a print array in which two nozzles are used to print one color in a limited image region and then a single nozzle is used to print a second color over the same region. These systems produce bands of print, print multiple colors in a single scan, and do not provide interlacing. Again, pluralities of arrays printing alternate lines and spaced in the advance direction are not shown.

An example of band color printing in which the color arrays are spaced in the scan direction is disclosed by Helinski et al. in U.S. Pat. No. 4,714,936 entitled "Ink Jet Printer". A black array is also provided that has more nozzles than those in the individual color arrays. No band, line or color interlacing is provided, All colors are deposited on a line in a single scan, so mixing of inks occurs. This printer uses rotating print arrays. The arrays are not formed as multiple-multiple-color arrays spaced in the advance direction for printing sets of alternate lines.

A form of line interlacing of color-band printing is disclosed by Hillmann et al. in U.S. Pat. No. 4,728,968 entitled "Arrangement of Discharge Openings in a Printhead of a Multi-Color Ink Printer". For letter-quality printing, the array is moved one half the draft-quality line spacing to print higher resolution images.

This requires a different print medium advance after alternate scans. Again, all of the colors in a given line are printed during a single scan of the print head across the medium. There is no disclosure of the use of multiple alternate-line printing multiple-color arrays.

Color arrays spaced in the direction of print medium movement are also disclosed in the references. Logan, in U.S. Pat. No. 4,680,596 entitled "Method and Apparatus for Controlling Ink-Jet Color Printing Heads", discloses such arrays for printing dots in pixels to vary color tone. In this patent, three dot rows, forming a single pixel row, are printed with each color during each scan. This, then, is a form of solid band printing of each color. The head measures about two inches by three inches. There is no band or line interlacing of colors. Further, with multiple ink drops per pixel per scan, there is mixing of ink of the same color, which creates line artifacts. The different color arrays are not formed as multiple arrays spaced in the advance direction for printing alternate lines in each array.

Another example of color-band-printing arrays spaced in the direction of medium movement is disclosed by Chan et al. in U.S. Pat. No. 4,812,859 entitle "Multi-Chamber Ink Jet Recording Head for Color Use". Four heads, one for each primary color and black, print adjacent solid bands. Band artifacts are thus produced and there is no line, band or color interlacing. There are no multiple-color arrays for printing alternate lines in each array.

In band printing by color arrays spaced in the direction of print medium movement, each color dries before the next color is deposited, and the colors are always deposited in the same sequence. When the color arrays are spaced only in the direction of scan movement, all the colors are deposited during each scan and the sequence of deposition is reversed for the two scan directions.

Prints generated by some serial dot-matrix color printers exhibit noticeable streaks parallel to the pen scan direction in areas printed in solid colors. These streaks can be either higher or lower in optical density than the surrounding area and occur where a band of color printed in one scan abuts a band of color printed in the next scan. Mechanical errors in paper-advance mechanisms and ink bleeding are two of the causes for this. To minimize the effect, the bands of color should be interlaced rather than abutted. As discussed herein, band interlacing of a color refers to the partial overlapping of a first printed band of the color with a subsequent printed band of the same color. This also requires line interlacing and results in the spacing apart of any printing defects due, for example, to a defect in a single printing element.

Line interlacing means that adjacent lines of dots of the same color are printed in sequential scans of the pen. For example, lines 1, 3, 5, etc., might be printed in one scan, while lines 2, 4, 6, etc., would be printed in the next scan. In a high speed printer, it is desirable to print in both scan directions. With line interlacing, any printing errors and hence image defects that might be dependent on the scan direction would be generated at the spatial frequency of the inverse line spacing and should be less noticeable than if they were generated at a lower spatial frequency.

Different types of inks are used in drop-on-demand printing. These are primarily water-based inks, oil-based inks, and hot-melt or thermoplastic inks. The latter inks are preferred, due to the intensity of the colors and the fact that they can be used on many different print mediums. A discussion of printing with colored inks, generally, and with hot-melt inks, in particular, is discussed by Howard et al. in U.S. Pat. No. 4,741,930 entitled "Ink Jet Color Printing Method". This patent specifically discloses the ink itself, rather than a printing process, other than disclosing that it is desirable to apply the different colors of ink to a spot after the prior application has set.

If dots of hot-melt ink that have not set are deposited continuously together or on top of each other, they mix. When they mix, the resultant color is different than it is if the first dot solidifies before the second dot is deposited. The color laydown sequence is also important. Different sequences produce color hue shifts and appearances of surface irregularities.

Ideally then, each of the multicolor overlay sequences should always be the same regardless of scan direction. If this is not possible, then the next best thing is to have the sequences alternate on adjacent lines so that the spatial frequency of the hue variations will be as high as possible and will be averaged out as much as possible by the visual system of an observer.

It can therefore be seen that it is desirable to provide line interlacing of each of the colors, band interlacing of each of the colors, and constant overlay sequence for each of the two-color combinations when printing bidirectionally.

A limitation on the configuration of arrays for printing interlaced lines is the physical size requirements of the ink jets. By varying the line of an array of nozzles in the direction of scan motion of the print head, nozzles can be positioned for printing on any lines desired.

Corresponding to the limitation in the closeness that nozzles can be placed together within an array, there are corresponding limits on how close two arrays can be placed together as well. There is thus a need to provide a print head having arrays that are spaced together as close as possible while still providing the desired print interlacing.

SUMMARY OF THE INVENTION

These features are variously provided by the present invention. Depending on the characteristics of the inks and mechanical systems used, the present invention provides a method and apparatus for substantially reducing color image irregularities while minimizing the number of address lines spanned by the array.

The preferred embodiment of the present invention is usable in a serial, dot-matrix, print-on-demand ink jet head described in U.S. Pat. No. 4,978,971 issued to Goetz et al. for "Method and Apparatus for Reformatting Print Data", assigned to the same assignee as the present invention. This disclosure describes an ink jet printer for printing with band and line interlacing of a single color such as would be used for monochromatic graphic or text images. This application is incorporated herein by reference.

The present application further improves on the above patent and on the known prior art by providing improved color imaging. Generally, the present invention provides an apparatus for printing an image on a print medium along print lines having centers spaced a predetermined interline distance apart.

An apparatus for printing such an image includes a print head that is movable relative to the print medium and has first and second linear arrays with a predetermined number of printing elements. Also included is a print head driver for moving the print head relative to a print medium in a first direction for addressing simultaneously a number of print lines corresponding to the number of printing elements in the two linear arrays. The first array addresses only even-numbered lines, and the second array addresses only odd-numbered lines. The print driver moves the print head relative to the print medium in a second direction transverse to the first direction an advance distance equal to the sum of the nozzles of each color in both arrays times the width of a line. This results in the second array addressing lines not addressed by the first array and all lines on the image area are addressed by the two arrays. The two arrays are spaced apart in the second or advance direction so that no adjacent lines are addressed at the same time during movement of the print head in the first direction.

In the preferred print head embodiment, four colors are printed and four spaced arrays are used. The first and second arrays are for printing three colors, with each array having an equal number of print elements for printing each color. The third and fourth linear arrays of print elements have the same number and spacing of print elements as the first and second arrays for printing a fourth color. The third and fourth arrays are spaced in the first direction from the first and second arrays, respectively, with the print elements in the third array addressing even-numbered lines and the print elements in the fourth array addressing odd-numbered lines.

The third and fourth arrays are also offset in the second direction relative to the first and second arrays by an offset distance equal to an integer times the advance distance. The first and second arrays are sufficiently separated in the second direction so that the printing elements in the third and fourth arrays that are offset in the second direction address lines not spanned by the first and second arrays.

This array structure allows the individual ink jets to be clustered together as close as possible while satisfying the requirements for line and band interlacing. Further, by assigning the primary colors to separate bands of nozzles within each array, the same deposition sequence of colors to produce secondary colors is provided, including the fourth color, which is typically black. With two of the arrays being used for black-only printing, text can be printed more rapidly than would otherwise be possible.

These and other features and advantages of the present invention will become apparent from a reading of the following detailed description of the preferred embodiment and method for practicing the present invention when read with reference to the associated drawings.

BRIEF DESCRIPTION OF THE DRAWINGS

FIG. 7 illustrates printing using a conventional head configuration.

DETAILED DESCRIPTION OF THE PREFERRED EMBODIMENT

Figure 1:
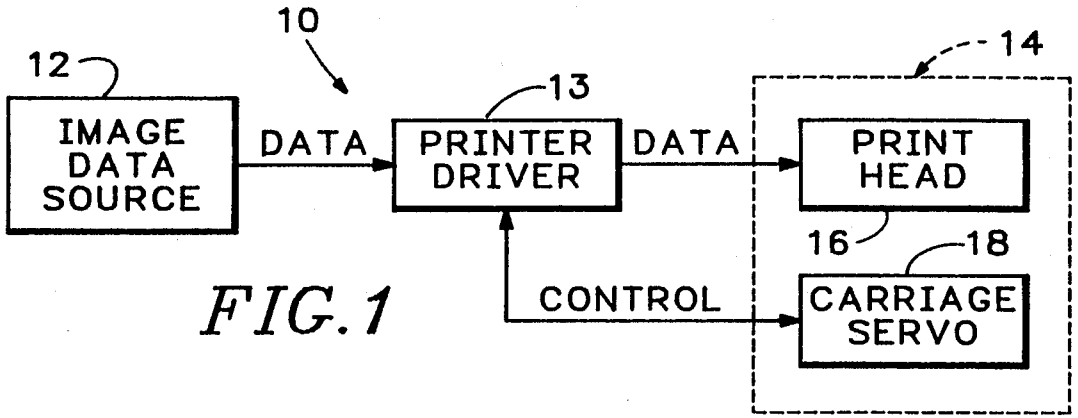
FIG. 1 is a general block diagram illustrating a printer apparatus including a print head made according to the present invention.

Referring initially to FIG. 1, a serial, dot-matrix printer 10 usable for practicing the present invention is shown. Printer 10 receives scan data from a data source 12. This data defines the colors to be printed at each pixel location on a predetermined image area of a print medium.

The data is fed into a printer driver 13 that controls operation of a print engine 14. Control includes feeding formatted data to a print head 16, the movement of which is provided by a carriage controlled by a carriage servo 18. Control signals are exchanged between the printer driver, the carriage servo, and other mechanical systems, not shown, such as a print medium mover to provide coordinated movement of the print head relative to the print medium during printing. A detailed description of a printer 10 usable for practicing this invention, is as described in the previously referenced patent entitled "Method and Apparatus for Reformatting Print Data". That application also describes well known prior art techniques for interlaced printing in a single color.

Figure 2:
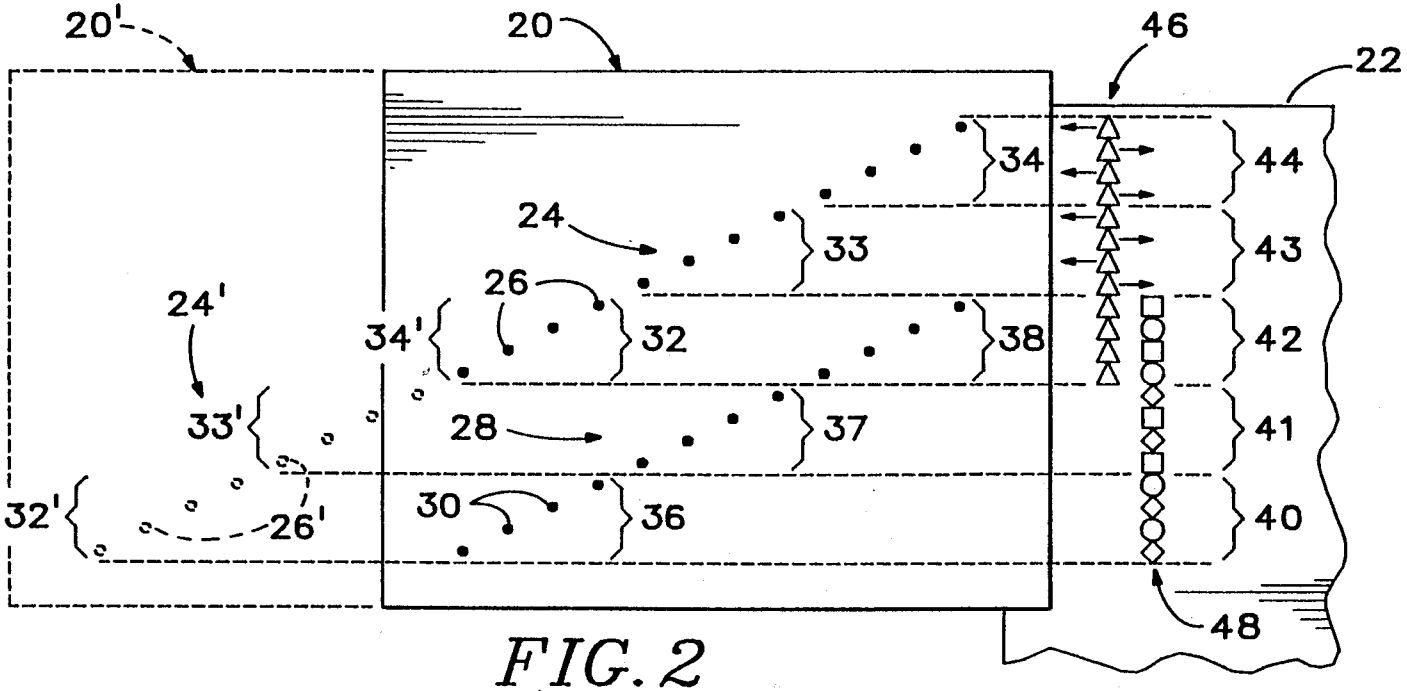
FIG. 2 is a diagram illustrating an exemplary ink jet head array configuration and representative color print scan of a print medium.

Referring now to FIG. 2, an exemplary print head face 20 usable in printer 10 is shown positioned next to a print medium 22, such as a sheet of suitable paper. Face 20 includes a first array 24 of individual black-ink-printing nozzles 26, and a second array 28 of color-ink-printing nozzles 30. It will be understood that black, white and various colors of the color spectrum in between are all considered colors. Face 20, and associated print head 16 thus prints using a plurality of colors. Printing occurs when the print head moves or scans horizontally, as viewed in FIG. 2 back and forth from left to right and right to left. This horizontal movement is also referred to as movement in a first or scan direction.

There are 12 nozzles in each array of nozzles. These arrays are divided into three sets of four nozzles. Array 24 comprises sets 32, 33 and 34. Array 28 comprises sets 36, 37 and 38. Array 24 is positioned vertically (in the direction of the print medium movement, which direction is also referred to as the second or advance direction) above array 28 so that sets 32 and 38 print on the same lines during a single scan of the print head. The six sets of nozzles thus print five sets 40, 41, 42, 43 and 44 of lines in a single scan.

In this figure and in FIGS. 3–12 which follow, ink colors are represented by a geometric symbol. In FIG. 2, a triangle represents black, and a square, a diamond, and a circle each represent one of three other colors, such as the three conventional subtractive primary colors, magenta, cyan and yellow. Other colors could also be used.

A column 46 of triangles on print medium 22 indicates the lines addressed for printing by the nozzles in array 24. A column 48 of squares, diamonds, and circles indicates the lines addressed by the nozzles in array 28. There is a mix of colors in column 48 that will be more fully discussed with reference to FIG. 3. Between scans the print medium is shifted or advanced upward relative to the arrays, the width D equivalent of four print lines, or the width of one set of print lines.

In order to achieve band and line interlaced printing of black, as provided in the prior art, the lines of the top two set of black nozzles print alternate lines as illustrated by the arrows associated with the triangle symbols. The arrows indicate which nozzles print during scan movement in the direction shown by the arrows.

The array configuration provides for printing with black ink after the primary colors are printed. This is important where the inks do not dry quickly or where there is bleeding of the colors. By printing black last, a constant sequence of deposition is provided relative to the other colors. Also, when printing only black text, array 28 is disabled and all nozzles in array 24 are used so that printing can take place three times as fast as during color image printing.

FIG. 2 shows an "ideal" embodiment in that black is always printed on a given line after all of the other colors have been printed. (Note: there is no occasion when black is ever printed at the same address as any of the other colors. Further, there is never an occasion when all of the three subtractive colors are printed at the same address.) This "ideal" embodiment extends the nozzle arrays in the vertical direction more than would be preferred. An alternative embodiment, shown in dashed lines in FIG. 2, has the black array 24' shifted so that there is a black nozzle 26' on every line there is a color nozzle. This is the most compact embodiment in the vertical direction, and in this sense, is also an "ideal" embodiment.

Figure 15:
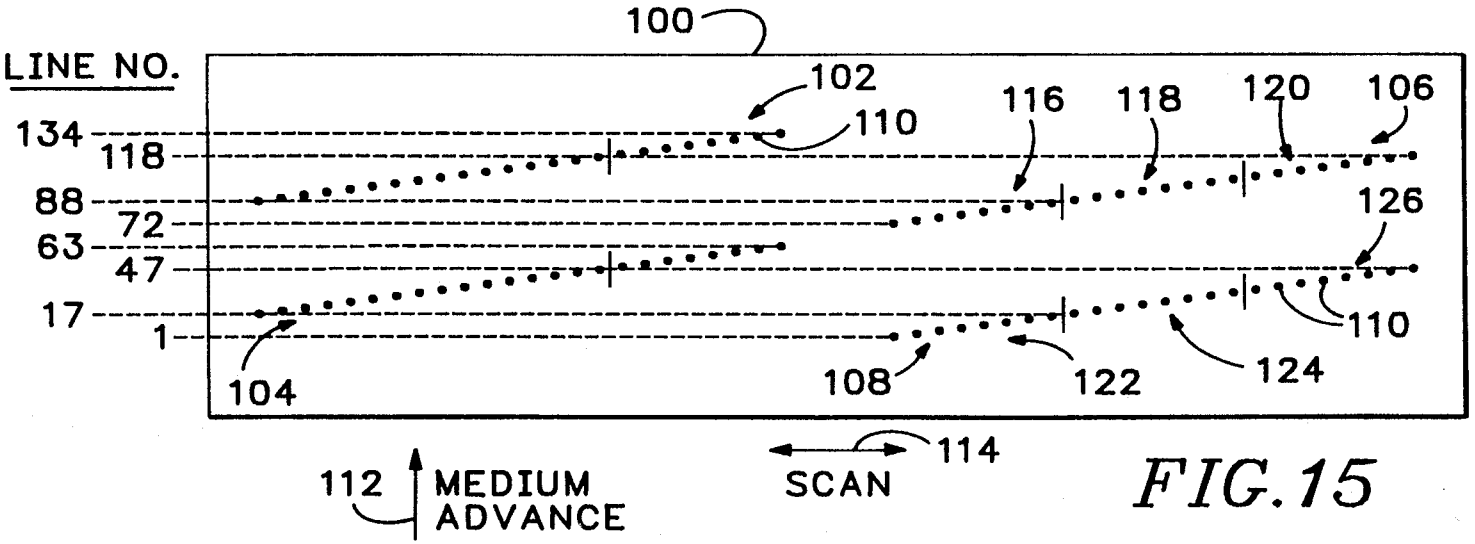
FIG. 15 is a diagram illustrating a print head face having four arrays of spaced nozzles made as illustrated in FIG. 14.

Faces 20 and 20' are shown for purposes of illustration. Each array in the intended commercial embodiment, as shown in FIG. 15, is four times the size of arrays 24 and 28. That is, there are 48 black-printing nozzles, and 48 multicolor-printing nozzles. Thus, instead of sets of 4 nozzles, there are sets of 16 nozzles.

The three base colors can be fed to nozzles 30 in any order desired. However, only specially ordered configurations will result in all lines being printed once and only once by each color. FIGS. 3–13 illustrate various arrangements that satisfy various ones of the desired features of a color printing system discussed earlier. In these figures, time is considered to progress from left to right. Thus, symbols shown on the same print line are considered to overlay each other, with the sequence of deposition occurring as determined by the deposition timing identified by sequential scans 1–3 or 4.

Figure 4:
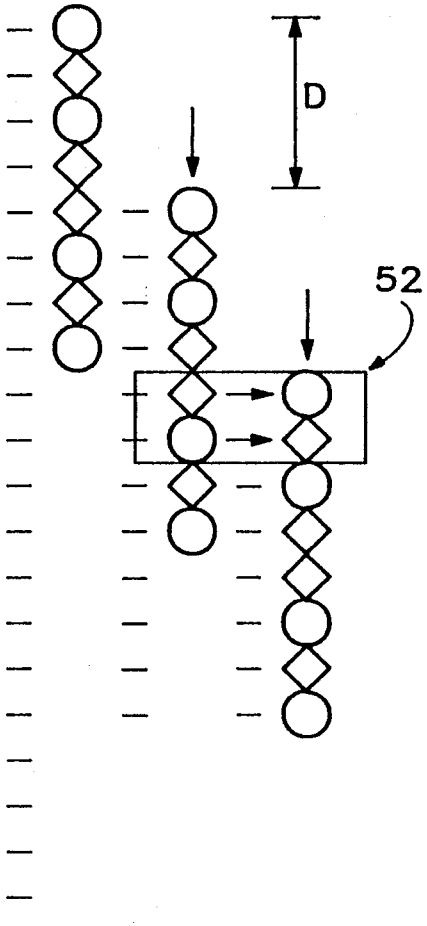
FIGS. 3 and 4 illustrate two-color printing using two configurations of the nozzles in a print-head array like that of FIG. 2 for achieving different overlay sequence combinations.
Figure 3:
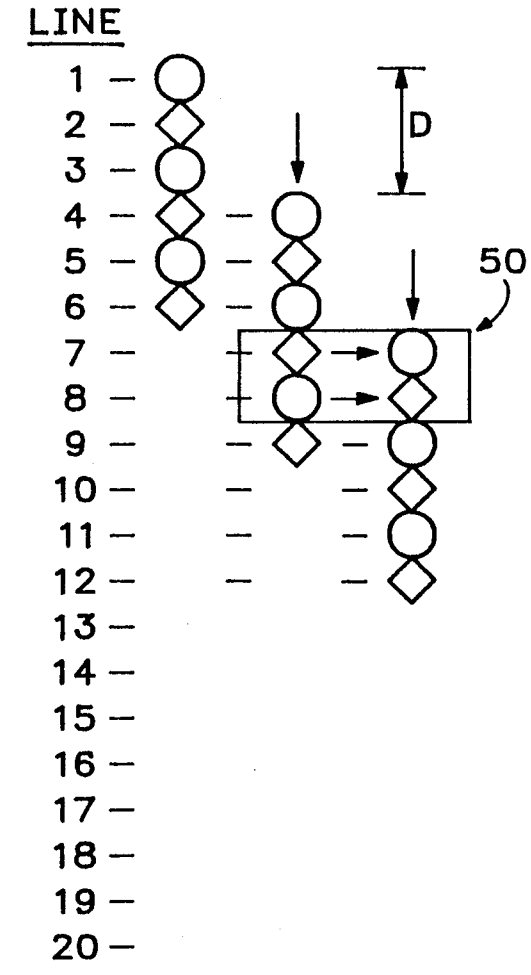

FIGS. 3 and 4 illustrate two configurations for printing two colors with color interlacing. FIG. 3 shows two colors represented as circles and diamonds that simply alternate within a set of printing elements for printing line-by-line alternating colors. In order to provide for constant incremental movements of the print head relative to the print medium, the number N of nozzles must be odd.

In FIG. 3, there are three nozzles of each color and the print head is shifted a distance D equal to the width of three lines between scans. The resulting overlay sequence is represented in the outlined region 50. It can be seen that the overlay sequence alternates with every line, except for the band edges.

This method and configuration provide for band and line interlacing. The band of a particular color is 5 ($2N-1$ for $N=3$) Incrementing by $N=3$ lines is as close as possible to get to $(2N-1)/2$ lines when incrementing by an integer number of lines. Line interlacing results because each color is printed on only odd numbered lines in one scan and only on even numbered lines in the next scan, since the incremental distance change D is equivalent to the width of an odd number of lines.

An alternative two-color printing configuration is shown in FIG. 4. The head color array is made up of two sets of four nozzles, with the nozzles alternating colors within each set, but with the placement of colors in each set reversed. For instance, during scan 1, the color represented by a circle prints on lines 1 and 3 in the first set and on lines 6 and 8 in the second set. As can be seen, the color in one set always prints on the odd lines and the same color in the other set always prints on the even lines.

As shown in outlined region 52, the overlay sequence alternates every line. Considering that the band of circles encompasses eight lines, and that for diamonds encompasses six lines, the circles have near perfect band interlacing, whereas the diamonds have partial band interlacing. Also, it can be seen that the diamonds are printed on two consecutive lines during each scan. Otherwise line interlacing is also achieved.

Figure 5:
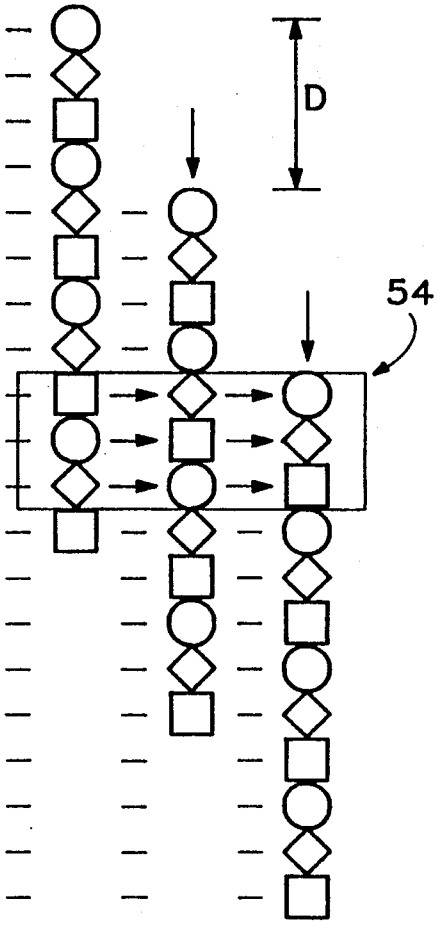
FIGS. 5–10 illustrate three-color printing with different head configurations.

FIGS. 5–10 show different head configurations for printing three colors, such as the primary subtractive colors, cyan, magenta and yellow. FIG. 5 illustrates the case where the three colors alternate within a single set of nozzles. In order to avoid duplicate printing of some lines, N, the number of nozzles of each color, must not be an integer multiple of three. In the example shown, there are four nozzles of each color and the array is advanced the width D of four lines between scans.

As shown by the outlined region 54, each line is only addressed once, and the overlay sequence of each color pair does not alternate perfectly line-by-line. The order of circle/square, square/diamond and diamond/circle repeats every two out of three lines. However, there is both band and line interlacing of each color.

Figures 6, 7, 8, 9:
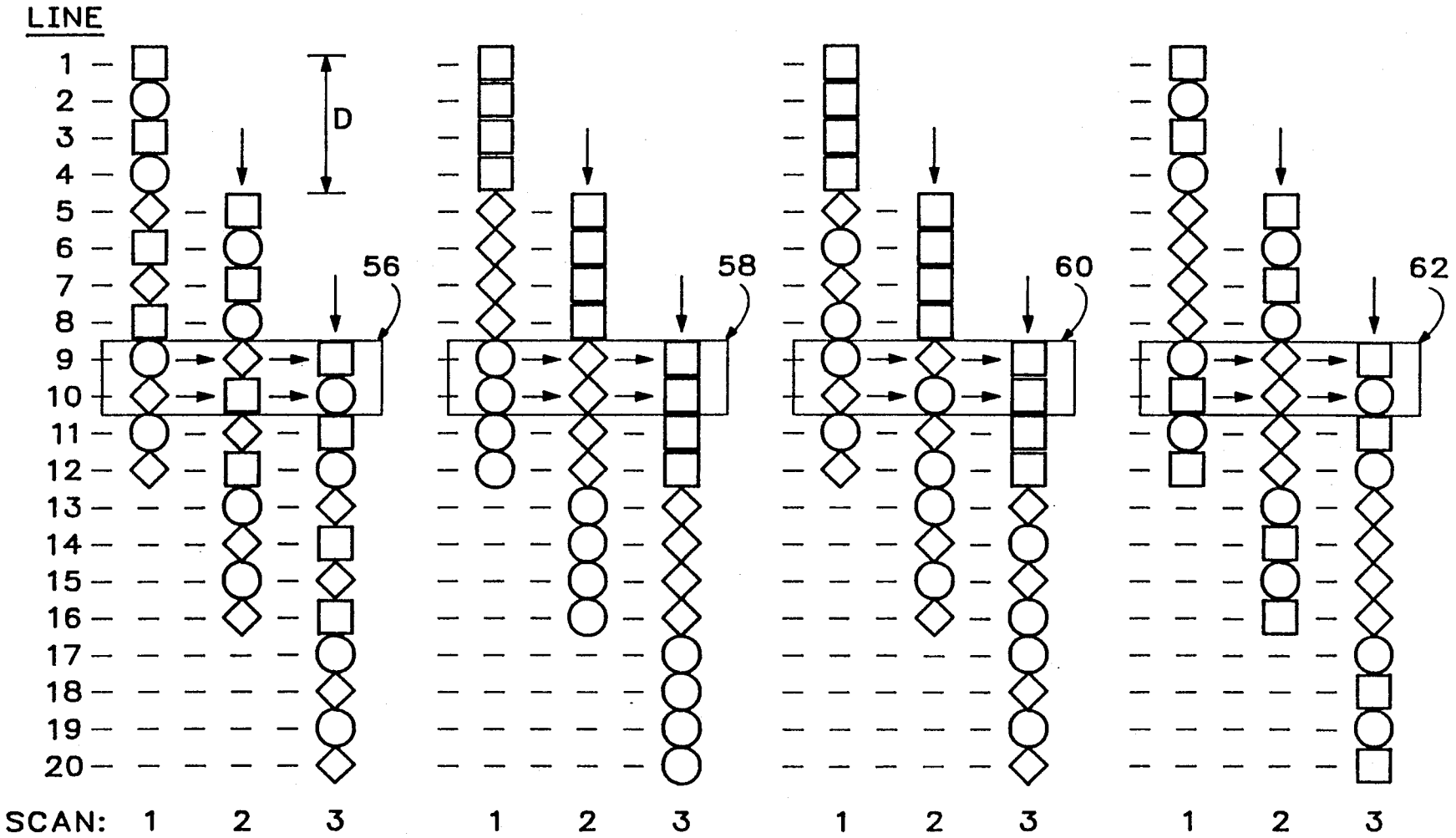
FIG. 7 PRIOR ART

The configuration shown in FIG. 6 is the same as that illustrated in FIG. 2 for the jets that print in color. Referring specifically to FIG. 6, three sets of four nozzles are used, with each set printing alternating lines of two colors. Each set prints a different one of the three pairs of colors: square/circle, diamond/square and circle/diamond. In the scan sequence shown, lines 9 and 10 are the first lines to be overlaid by all three sets of nozzles. The resulting overlay sequence is represented in the outlined region 56. The ink drop locations in line 9 are addressed ("printed") first by the nozzle printing the color represented by the circle, followed by the nozzle printing a diamond and then by a nozzle printing a square. Thus, the circle is printed before both the diamond and the square, and the diamond is printed before the square.

Preferably, no more than two colors are printed at a single ink drop address location. Printing all three at one address results in "composite" or "three-color" black which always has a noticeable, dingy and repugnant hue. This arises because the subtractive primary colors are not ideal. Thus, it is better to print a single drop of pure black.

In line 10, the diamond is printed before the square and the circle, and the square is printed before the circle. This alternating pattern applies to all of the lines printed, as could be illustrated by continuing to draw columns for scans 4 and beyond.

Relating this to FIG. 2, diamonds (a first color) and circles (a second color) alternate in first set 36 of print elements, squares (a third color) alternate with diamonds in second set 37 of print elements, and circles alternate with squares in third set 38. It will be seen that when a color is printed on odd lines in one set it is printed on even lines in a different set, so that all lines will be printed by each color.

The printing method illustrated in FIG. 6, and the print element array associated with it, provide for band interlacing of squares and diamonds, and line interlacing of all three colors. The bands of squares and diamonds each span thirty-two lines in this embodiment. This array also provides a constant deposition order for one pair of colors (diamonds and squares), and provides alternative deposition orders for the other two pairs of colors (circles and diamonds, and circles and squares) on adjacent lines.

In FIG. 7, each of print head sets 36, 37 and 38 have a single color, as is conventionally known. The first set is circles, the second set is diamonds, and the third set is squares. As shown in outlined region 58, this results in the three colors being deposited in a constant order for all lines printed. That is, the circles are printed before both the diamonds and the squares, and the diamonds are printed before the squares. However, each color is neither band interlaced nor line interlaced.

FIG. 8 shows yet another embodiment, this one having the first two print element sets 36 and 37 alternating between circles and diamonds, and the third set 38 all squares. As shown by outlined region 60, this embodiment provides both line and band interlacing for two colors (circles and diamonds) and a constant color overlay sequence for two of the color pairs (diamonds and squares, and circles and squares). However, the third color (squares) is neither line nor band interlaced.

In FIG. 9 the set 37 of printing elements printing a single color, diamonds in this case, is in the middle. The first and third sets 36 and 38 alternate colors represented by squares and circles. As shown by outlined region 62, this configuration provides alternating overlay sequences for all three color pair combinations. However, one of the colors—diamonds—is not line interlaced. There is no band interlacing at all.

Figures 10, 11, 12, 13:
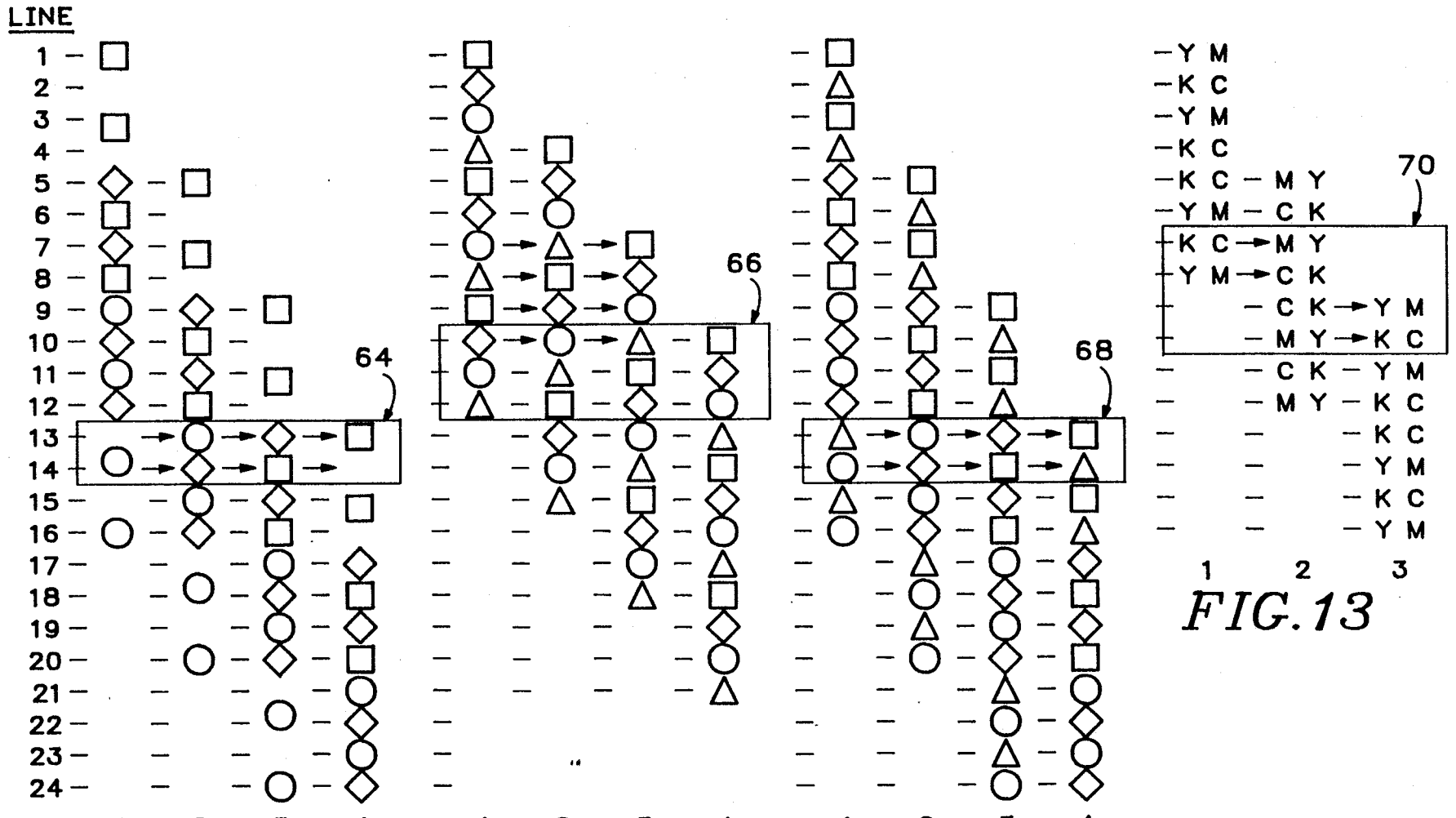
FIGS. 11–13 illustrate four-color printing with different head configurations.

The last three-color configuration is illustrated in FIG. 10. This configuration diverts from the previous configurations in which every line within the range of the print array is printed (addressed). This configuration requires four sets of nozzles. The two end sets each print a different single color on alternating lines. The two intermediate sets print alternating lines of two different color pairs. Four scans are required in order to have each line addressed by each of the colors, as is illustrated in outlined region 64.

This configuration, though it requires a larger print head (4N−1 rather than 3N−1 address lines), provides a constant overlay sequence for all three colors. Further, there is band interlacing and line interlacing for all three colors.

FIGS. 11-13 illustrate configurations for printing four colors. In FIG. 11, there is a single set with the colors alternating in each set. If N, the number of nozzles per color, is even then the print head must be incremented on alternating scans by N−1 and N+1 lines. For N odd, regular increments of N lines after each scan provides printing of each color once on every line.

N=3 in the figure. As shown in outlined region 66, four scans are required in order to have every line addressed by every color. This results in three increments per band, which averages out any anomalies due to band edges. There also is complete line interlacing. However, the overlay sequences vary between not alternating at all to alternating every second line. The results are therefore inconsistent.

FIG. 12 illustrates a preferred arrangement for printing four colors, where all four colors are given an equal number of nozzles. In this case a first set of four nozzles alternates between triangles and squares, the second set between diamonds and squares, the third set between diamonds and circles, and the last set between triangles and circles, as shown. The respective colors are assigned so that they print on even lines in one set and on odd lines in the other set in which they appear. A comparison on this configuration with the three-color configuration of FIG. 10 will show that they are identical as to the colors represented by squares, diamonds and circles. The triangles have been added where there were nozzle omissions in FIG. 10.

As is apparent in the outlined region 68, the overlay sequence is the same for the three colors of FIG. 10. The sequences alternate every line for the combinations with the fourth color. This scheme would therefore be useful where black is assigned to the triangle positions and the three primary colors are assigned the other three symbol positions. This configuration produces line and partial band interlacing.

FIG. 13 illustrates a configuration in which the four colors are treated as two sets of two colors. Each pair of colors, here yellow (Y) and black (K), and magenta (M) and cyan (C) are given the same array configuration as the two colors of FIG. 4. There are thus two sets for each color pair, with the two arrays printing on the same print lines. Alternatively, one two-color array could be positioned vertically, as represented here, to form a single line of both arrays so that there is a delay between the printing of color pairs. The print head in such an arrangement is, however, much less compact.

The configuration of FIG. 13 is particularly desirable for hot-melt ink, where the inks combine when placed on top of or next to drops of ink that are not set. Since black is not applied to a spot that has another color, it is never combined on the same spot with other colors. The main color combinations alternate line-by-line except for yellow and magenta, which produce red, as shown by outlined region 70. This color pair stays the same on alternate two-line intervals. Since the eye is much less sensitive to red than to green, stripes or other anomalies will be less apparent. Alternatively, magenta and cyan, which produce blue, could also be used for this inconsistent color-overlay sequence pair. It is advantageous having cyan and yellow on different lines to allow the spots of ink to set between scans in order to produce a more consistent green.

As suggested by the embodiment shown in FIG. 10, the nozzles could be vertically separated by twice the interline spacing so that no two color dots within the same array print on adjacent lines. This, however, doubles the size of the array.

The arrays of a print head illustrated in FIG. 2 becomes very wide when made with ink jets that are essentially identical in construction. A design has been developed in which channels extend from spaced locations to the line of nozzles in order to achieve the close spacing. An alternative design, that achieves the same ink jet density while using ink jets having an ink reservoir close to the nozzle or ink orifice is shown in FIG. 14.

This design provides for the placement of ink jets 80 in a honeycomb configuration. Each jet includes a reservoir 82 of ink with a piezoelectric element for driving the ink through an offset channel 84 to a nozzle or orifice 86. Instead of having extended channels leading to a line of orifices through the middle of the honeycomb structure, the jets are placed as shown adjacent one of two lines 88 and 90 forming spaced nozzle arrays 92 and 94.

Figure 14:
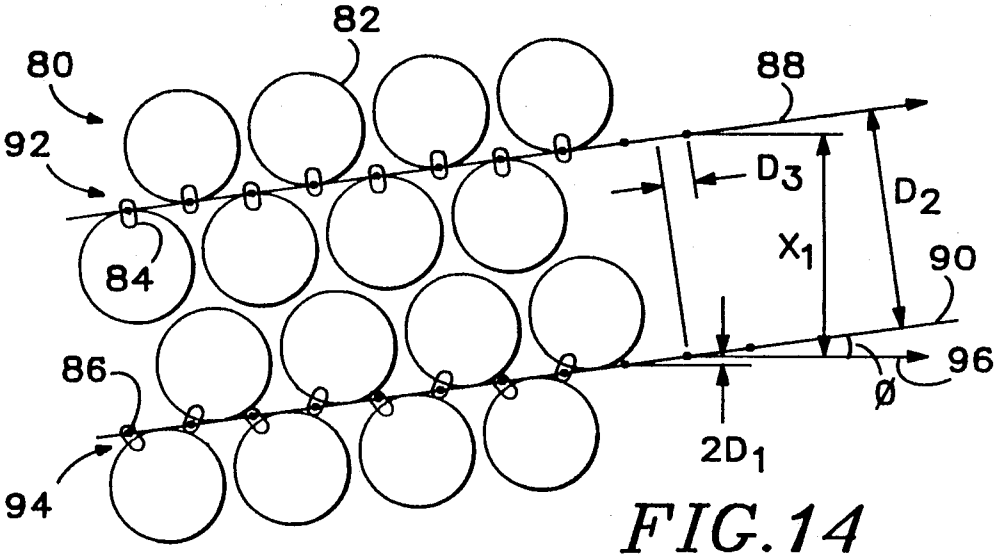
FIG. 14 illustrates a portion of two print arrays in a print head made according to the present invention.

In FIG. 14, $D_1$ is the spacing between the centers of adjacent printed lines, or the effective width of a single line. $D_2$ is the distance between the parallel nozzle lines 88 and 90. $D_3$ is the offset on nozzles in one line relative to the other line. $X_1$ is the distance in the advance direction of movement of the print medium relative to the print head between scans. Lastly, the Greek symbol $\phi$ is the angle of lines 88 and 90 relative to the scan direction represented by arrow 96.

In order to achieve line interlacing, $X_1=(2N_1+1)D_1$, where $N_1$ is an integer. With printing of a color by two arrays spaced in the advance direction, the nozzles for that color in one array must print even-numbered lines and the nozzles in the other array must print odd-numbered lines.

Further, if band interlacing is to also be achieved, then $X_1 \approx (N_2+\frac{1}{2})ND_1$, where $N_2$ also is an integer, and N is the distance in number of lines equivalent that the print medium is moved each scan. Using a pixel density of 300 dots per inch (DPI), $D_1=3.33\ldots$ mils. The ink jets have a diameter of approximately 4 mm, or 157.5 mils. The distance between orifices in line 88 or 90 is approximately 67 mils or the width of 20 lines. With the spacing in the advance direction of the distance of two lines, this results in a 1:10 slope of the lines, or an angle $\phi$ of 5.7°. The distance $D_2$ is 232.09 mils, resulting in a closest value for $X_1$ of 234.50 mils. A value of $X_1=6.66\ldots$ is equivalent to the width of 71 lines.

This configuration thus substantially satisfies the two equations for $X_1$, where $N=16$, $N_1=35$, and $N_2=4$. As has been mentioned the preferred commercial embodiment has 96 nozzles, 48 printing black and 48 printing the three primary colors. There are thus 16 nozzles for each color and the print medium is advanced the distance of 16 lines for each scan.

FIG. 15 shows the resulting layout of a print head face 100 including the nozzle configuration described with reference to FIG. 14. There are four arrays 102, 104, 106 and 108 of 24 nozzles 110. Arrow 112 shows the direction of print medium advance relative to the print head, and arrow 114 shows the direction of print head movement during scanning. Arrays 102 and 104 print black only, and arrays 106 and 108 print the three colors.

Array 106 thus contains subarrays 116, 118 and 120 for printing bands of first, second and third colors, respectively. Similarly, array 108 contains subarrays 122, 4 and 126 for printing the same colors in preferably the same respective order.

Since the separation between arrays 102 and 104, and between arrays 106 and 108 in the advance direction is the width of 71 lines, an odd number, one array of each of these pairs of arrays prints odd-numbered lines and the other array prints even-numbered lines. Representative line numbers are listed to the left of the print face with dotted lines relating them to corresponding nozzles. As shown, the nozzles in arrays 102 and 106 address only even-numbered lines and the nozzles in arrays 104 and 108 address only odd-numbered lines.

Further, array 102 is offset in the advance direction relative to array 106, as is array 104 relative to array 108, a distance equal to the width of 16 lines. This results in the capability of printing black dots on lines not printed by arrays 106 and 108 during each scan. When only black is printed, such as for text, arrays 106 and 108 are disabled and the entire arrays 102 and 104 are used.

By using the nozzle configuration of FIG. 15, several advantages are realized. Line interlacing is provided, since only alternate lines are printed during each scan, even when only black is printed. This also assures there is no bleeding of colors between adjacent lines. Band interlacing is provided, since one array prints about half way into the band printed by the other array, for each color. By band printing the colors, there also is constant sequence of overlay of the primary colors, regardless of the scan direction, resulting in constant hues or tones for each overlay combination. Additionally, by printing only alternate lines and only one color per line during each scan, the ink has time to dry or set before a second color is deposited on it.

It will be appreciated that although the invention has been described with reference to a preferred embodiment, variations in form and detail may be made without varying from the spirit and scope of the invention as defined in the claims.

We claim:

1. An apparatus for printing a color image formed of print lines printed selectively over a predetermined area of a print medium, with adjacent print lines having centers spaced a predetermined interline distance apart, the apparatus comprising:

a print head movable relative to the print medium and having first and second linear arrays, each array having a predetermined number of printing elements for printing a plurality of colors, each printing element for selectively printing one of the colors when the printing element addresses a print line; and means for moving, repeatedly, the print head relative to a print medium in a first direction for addressing simultaneously a number of print lines corresponding to the number of printing elements in the two linear arrays, with the printing elements of the first array addressing only odd-numbered lines, and the printing elements of the second array addressing only even-numbered lines, the moving means moving the print head relative to the print medium in a second direction transverse to the first direction, between movement sin the first direction, an advance distance equal to the interline distance between the centers of adjacent lines times the number of lines printed with each color in both arrays so that in a subsequent printing the printing elements of the second array address lines not addressed by printing elements of the first array in a precedent printing and all lines on the image area are addressed by the two arrays, the two arrays being spaced apart in the second direction so that no adjacent lines are addressed at the same time during movement of the print head in the first direction.

2. An apparatus according to claim 1 wherein the distance between the line of one of the arrays and the line of the other of the arrays in the second direction is equal to an odd integer times the interline distance.

3. An apparatus according to claim 2 wherein the first and second arrays are for printing three colors, each array having an equal number of print elements for printing each color, the apparatus further comprising third and fourth linear arrays of print elements having the same number and spacing of print elements as the first and second arrays for printing a fourth color, with the third and fourth arrays being spaced in the first direction from the first and second arrays, respectively, the print elements in the third array addressing odd-numbered lines and the printing elements in the fourth array addressing even-numbered lines.

4. An apparatus according to claim 3 wherein the third and fourth arrays are offset in the second direction relative to the first and second arrays by an offset distance equal to an integer times the advance distance.

5. An apparatus according to claim 4 wherein the first and second arrays are sufficiently separated so that print elements in the third and fourth arrays address lines not addressed by print elements in the first and second arrays.

6. An apparatus according to claim 5 wherein the print element in the first array that addresses a line that is closest in the second direction to a line addressed by a print element in the second array, is separated from the print element in the second array addressing the closest line by a distance equal to the advance distance times N.5, where N is an integer.

7. An apparatus according to claim 1 wherein the distance between the line of one of the arrays and the line of the other of the arrays in the second direction is equal to the product of the advance distance and N.5, within ± the interline distance, where N is an integer.

* * * * *